United States Patent [19]

Cannom et al.

[11] 4,188,607

[45] Feb. 12, 1980

[54] VARIABLE IMPEDANCE DEVICE

[76] Inventors: David L. Cannom, 276 Cabrillo #C, Costa Mesa, Calif. 92627; Carlos M. Del Rio, Pipila No. 113, Irapuato, Guanajauto, Mexico

[21] Appl. No.: 965,683

[22] Filed: Dec. 1, 1978

[51] Int. Cl.[2] ..... H01C 8/00

[52] U.S. Cl. ..... 338/224; 338/223

[58] Field of Search ..... 338/224, 223, 273, 274, 338/225; 252/512

[56] References Cited

U.S. PATENT DOCUMENTS

| | | | |
|---|---|---|---|
| 1,397,888 | 11/1921 | Chodrow | 338/224 |
| 2,845,515 | 7/1958 | Anderson et al. | 338/273 X |

*Primary Examiner*—C. L. Albritton

*Attorney, Agent, or Firm*—Grover A. Frater

[57] ABSTRACT

A variable impedance device which serves to improve performance and reduce radio frequency emissions in electrically fired internal combustion engines employs a mixture of granulated or powdered bronze, or the constituents of bronze and of silica compacted and continually compressed for connection in series with the ignition wiring of an engine. The proportions of metal and silica are such that an irregular but complete conductive pathway is formed through the mixture. In preferred form the powders or granules are compressed within a fused silica lined sheath of stainless steel.

11 Claims, 7 Drawing Figures

VARIABLE IMPEDANCE DEVICE

This invention relates to improvements in variable impedance devices for use in connection with internal combustion engines and to methods for making such devices.

BACKGROUND OF THE INVENTION

Devices according to the invention serve at least two useful purposes when included in series in the ignition wiring of electrically operated internal combustion engines. They improve engine performance and they serve to suppress radio interference. Nothing similar to the invention is known in the art of engine performance control except that it appears that the use of ignition circuit conductors of powdered carbon, ordinarily used as an aid to suppressing radio interference in automobiles, may have an effect on engine performance. The invention employs an element in the form of compacted and compressed granules of metal mixed with silica grains.

While the principle of operation of the invention is unknown, a number of theories have been advanced, including the proposal that positive ions migrate from the impedance element through the electrical system and spark plug, there to participate either as active elements or as catalytic agents in the combustion reaction or both. It is proposed that silica ions provide a catalytic action and that the metallic ions participate in formation of new materials in an exothermic reaction of some kind. The contention that carbon conductors in radio interference suppression ignition wires affect engine performance, and the observation that the invention acts to suppress radio interference have prompted speculation that improved performance of the engine is accounted for by attenuation of high frequency components in the waveshape of ignition current pulses.

SUMMARY OF THE INVENTION

Whatever the principle of operation, or however many principles are involved, it remains that it has been discovered that a compacted and continually compressed mixture of silica granules or powder with granules or powders of bronze or of the metals which alloy to make bronze have a material affect upon engine performance and serve to suppress those components of the ignition system current wave that give rise to radio noise interference. The use of powders or grains of bronz alloy is referred. It is an object of the invention to provide structures which exhibit those advantages and to provide methods for making such structures.

The ratio of metal powders to silica is such that a continuous metallic conduction path is formed. A complete, low resistance path for unidirectional current is required. Inclusion of the non-conductive granules is also required, and it appears that silica granules are required for best results. Enough silica is used to result in the current path being tortuous and irregular. That might promote electric fields and potential gradients that aid in ion migration or current wave shaping, or both. What is known is that the use of bronze that includes antimony or addition of antimony powders or grains to the mixture is beneficial. Addition of that material makes possible an increase in the proportion of silica in the range of useful proportions.

In the preferred embodiment, connection to the mixture is made through terminals of bronze metal which is partially imbedded in the mixture. Uniformity of performance is insured by compacting the mixture and maintaining it under pressure. That is accomplished in the preferred embodiment by placing the mixture in an outer sheath and swagging or compressing the sheath to smaller dimension. A preferred sheath is a stainless steel tube whose inner surface has been glazed. Two or more of such units may be connected in parallel, preferably with common-end connection terminals.

It is not known why, but the inclusion of such a device in the ignition wiring of an automobile appears to result in an improved performance. In any event, in a number of cases, automobiles have performed better after addition to their ignition wiring of a device such as those herein described. Milage is improved in some cases, spark plugs remain clean, engine oil remains clean longer, and pre-ignition or "knocking" is reduced. Carbon build-up in the cylinder head is greatly reduced.

Whatever the cause, the impedance of the device varies with frequency and to some extent with current magnitude. Thus, it is a variable impedance device and has utility just as does any non-linear impedance element.

The several theories mentioned above are offered not as distinguishing characteristics of the invention, but only as possible explanations in the matter of improved engine performance. Certain preferred embodiments of the invention, the best mode of practicing the invention that has been devised, are shown in the accompanying drawing and described below. It is to be understood, however, that other embodiments are possible and that the invention is not limited to the embodiments shown, but that its scope is to be measured instead by the scope of the appended claims.

THE DRAWINGS

DESCRIPTION OF THE INVENTION

Figure 1:
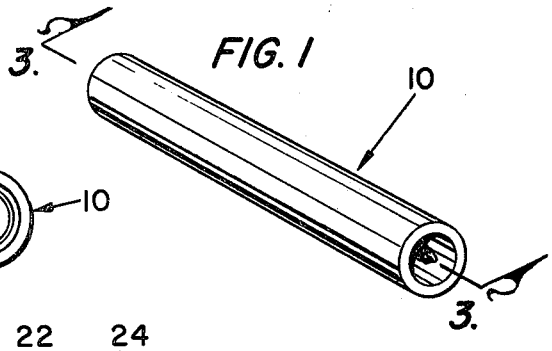
FIG. 1 is an isometric view of a device according to the invention.

The unit 10 of FIG. 1 is a simple form of the invention. It is elongated, cylindrical and is fitted with axially extending threaded terminal screws, one on each end. It is used by including it in series with the ignition wires of an automotive engine. It may be placed in series with the central distributor conductor, or similar units may be included one in each of the wires from the distributor to the several spark plugs of the engine. The latter is preferred, and the units should be placed as close to the spark plug as they conveniently may be so placed.

Figure 2:
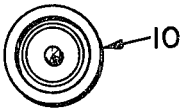
FIG. 2 is an end view of the device of FIG. 1.
Figure 3:
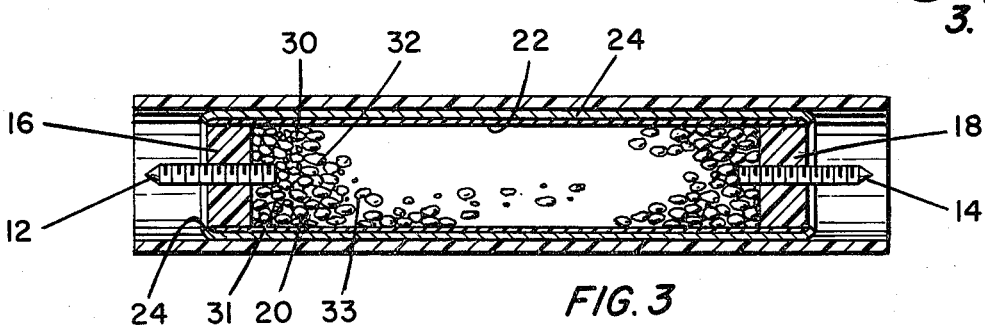
FIG. 3 is a longitudinal cross-sectional view taken on line 3—3 of FIG. 1.

As best shown in FIGS. 2 and 3, the unit is symmetrical both about its longitudinal axis and about the transverse mid-plane along its length. The two threaded end terminal screws are numbered 12 on the left and 14 on the right. They extend from their exposed ends through insulators 16 and 18, respectively, into opposite ends of a body or length 20 of compacted granules or powder. The grains are shown greatly enlarged to illustrate that they are grains or granules, and most of them have been omitted for the sake of clarity and so that several wall thicknesses of the materials surrounding the granules are more readily recognizable.

The innermost of those wall thicknesses is a layer 22 of glaze formed on the entire interior surface of a stainless steel tube 24. The tube 24 is press-fitted within an outer tube 26 of plastic, electrically insulating material.

The glaze layer 22 may be formed by any suitable means, but in preferred form is a thin layer of silica glass which is bonded to the stainless steel sheath 24 by covering the inner surface of the sheath with silica and heating them both to a temperature approaching 1200° celcius at which the silica turns to glass and is bonded to the interior surface of the tube or sheath. Thus prepared the sheath is cooled and is filled with the granular mixture 20. The end insulators and screw terminal assemblies are inserted into the ends of the sheath 24 one at each end as shown in FIG. 3. Thereafter, the rim of the tube is crimped inwardly to smaller diameter at each one end whereby the insulators and terminals are traped in place. The screw terminals extend into the body or length of granular material and make electrical contact with that material.

The granular material must be tightly compacted and in preferred form, as here, is held under compression. That can be accomplished in several says. It is preferred that the assembly of glazed sheath, granules, insulators and terminals be compressed by swagging the tube 24. The glaze layer 22 will be cracked in the process, but it will remain as a layer around the granules insulating the metallic particles from the stainless steel sheath whereby current flow is limited to flow through the metallic granules as it flows between terminals 12 and 14.

The ratio of metal to silica particles in the body 20 of materials must be such that a continuous low resistance path formed between the two terminals. On the other hand, there must be a proportion of silica great enough to make the conductive path as irregular one and, according to one theory of operation, it is the outer margins of the conductive path that must be irregular so that current that is confined by skin effect to those outer margins experiences direction change and field gradient variations that result in self induction or otherwise effect high frequency component flow. The ratio is variable with particle size and degree of compaction. When the granules are a mixture of powdered or granulated tin and copper, or tin-copper bronze and silica, the silica should comprise four to ten percent by volume of the whole. The porportion of tin to copper should be between three to four volumes of tin to one volume of copper. The mixture 20 in FIG. 3 is within that range.

To verify that mixture 20 does include metal particles and silica particles, one of the silica particles has been numbered 30. A tin particle has been numbered 31, one of the copper particles has been numbered 32, and a bronze alloy particle has been numbered 33.

Figure 4:
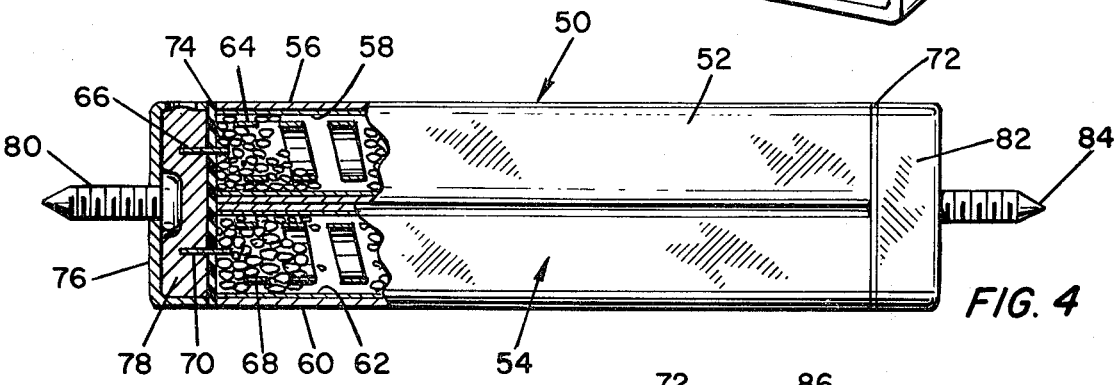
FIG. 4 is a view in side elevation, partly in section of a preferred form of the invention.
Figure 5:
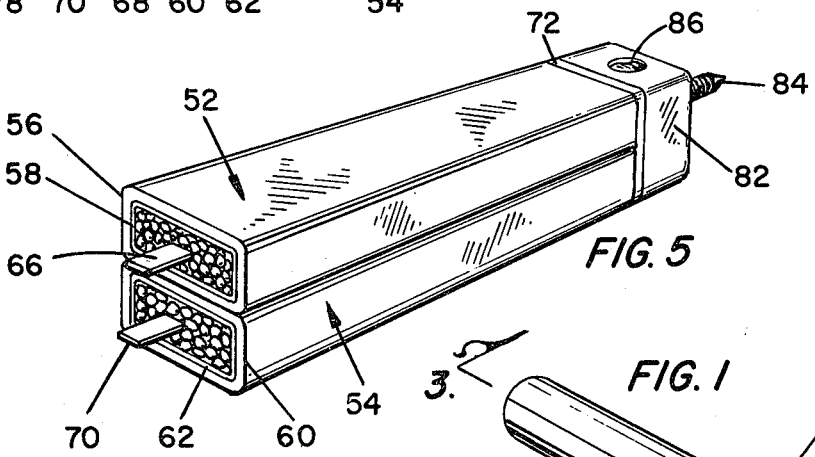
FIG. 5 is an isometric view of the unit of FIG. 2 with one end removed.

The task of making the swagged assembly is made easier, and function is enhanced by making several units of relatively small cross-sectional areas and connecting them in parallel. The device of FIG. 4 is so constructed. Generally designated 50, it includes two units swagged and compressed to generally rectangular shape in cross-section as best shown in FIG. 5. The two units are laid side by side and are then interconnected by end terminal structures so that they are connected in parallel.

In FIGS. 4 and 5, the upper and lower ones of the two units are numbered 52 and 54, respectively. Each comprises a stainless steel outer sheath whose inner surface is glazed by a fused silica layer fused to it. In the case of unit 52 the sheath is numbered 56 and the glaze layer 58. The sheath of unit 54 is numbered 60 and its glaze layer is numbered 62.

Figure 6:
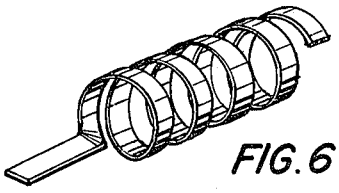
FIGS. 6 and 7 are isometric views of components of the unit of FIG. 4.

Instead of bronze screw terminals, the units 52 and 54 employ special, large contact area terminal structures of the kind shown in FIG. 6. They are made of flat bronze wire wound to spiral shape with one end bent out straight substantially along the axis of the spiral. Four such terminals are employed. Each has its spiralled part imbedded in the granules of a respective end of a respectively associated unit and its straight portion extending from those granules. During swagging of the sheath the spiral is forced to a rectangular shape from the cylindrical shape shown in FIG. 6. Portions of two of the connectors are visible in the drawings. Connector 64 is visible in FIG. 4 in cross-section where it forms part of unit 52. Connector 68 is also visible in that figure where it forms part of unit 54. The end part 66 of connector 64 is seen in FIG. 5 as is the end part 70 of connector 68.

Figure 7:
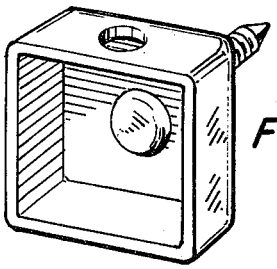

The two units 52 and 54 are laid side by side, and their ends are closed by a layer of insulating material through which the straight portions of the connectors extend. The insulating layers are numbered 72 at the right and 74 at the left. To complete the assembly, an end cap like that shown in FIG. 7 is filled with molten solder. The pair of units 52 and 54 are held above the molten solder and are lowered until the end insulator lies flat upon the rim of the cup with the connector ends immersed in the molten solder. An overflow hole, or fill hole, in another bonding process, releases excess solder. The solder is allowed to cool and the end member is bonded in place with solder bonded to the terminals and to the cup. In FIG. 4 the cup is numbered 76 at the left. It is filled with a body of solder 78 which is bonded to the interior of the cup and to the exterior of connector portions 66 and 70.

A flat headed screw 80 extends through the bottom wall of the cup with its head inside fixed in place not only by the solder body but because the screw is threadedly connected to the cup bottom. The cup at the other end of the device is numbered 82. Its screw is numbered 84 and its overflow hole, or fill hole, 86 is visible in FIG. 5.

The granular material in the case of unit 52 is the same as the material employed in the unit of FIGS. 1, 2 and 3. The granular material in the case of unit 54 is different. This one is a combination of tin, copper, tin-copper aloy, and antimony in approximately (within a few precent) the proportion by volume of fifty parts of tin to twenty parts of copper, and ten parts of antimony. A higher proportion of silica is used with this combination of metals. The proportion should be, and in this case is, in the range of 15 to 25 parts by volume of silica to eighty parts of metal powder or grains. If one must be selected as best, it now appears that the antimony formula is best in the application to most automobiles. However, since the non-antimony formula seems best in other cases, both formulas are used in the preferred embodiment shown in FIG. 4.

Although we have shown and described certain specific embodiments of our invention, we are fully aware that many modifications thereof are possible. Our invention, therefore, is not to be restricted except insofar as is necessitated by the prior art.

We claim:

1. A variable impedance device comprising a pair of electrodes electrically interconnected by a length of a compacted conductive mixture of granulated silica and the metal constituents of bronze, and enclosure means for retaining said mixture.

2. The invention defined in claim 1 in which the ratio of bronze constituents to silica is such that the grains of bronze constituents form a continuous electrically conductive path throughout said length.

3. The invention defined in claim 1 in which the bronze constituents comprise tin and copper in a ratio between three to one and four to one by volume.

4. The invention defined in claim 3 in which silica comprises between four and eight percent of the volume of said mixture.

5. The invention defined in claim 1 in which said compacted mixture is held under compression within an electrically insulating enclosure.

6. The invention defined in claim 5 in which said enclosure comprises glazed silica.

7. The invention defined in claim 6 in which said enclosure comprises a glass lined stainless steel sheath.

8. The invention defined in claim 7 which further comprises electrical end terminals imbedded in said mixture and formed of bronze.

9. The invention defined in claim 1 which comprises two lengths of said compacted mixture each encased in a silica lined sheath and a pair of end terminal structures one in electrical contact with, respectively, associated ends of both of said lengths and the other one in electrical contact with the opposite end of both of said lengths whereby said lengths of compacted mixture are connected in parallel electrical circuit between said terminal structures.

10. The invention defined in claim 9 in which said metal constituents comprise copper and tin in the approximate ratio of from three to four parts of tin by volume to one part of copper and in which silica comprises from four to eight percent by volume of said mixture.

11. The invention defined in claim 9 in which said constituents comprise copper, tin and antimony in the approximate proportion by volume of fifty parts of tin to ten parts of antimony to twenty parts of copper and in which silica comprises from fifteen to twenty-five percent by volume of said mixture.

* * * * *